US012006717B2

(12) United States Patent
Wood

(10) Patent No.: US 12,006,717 B2
(45) Date of Patent: Jun. 11, 2024

(54) PORTABLE CANOPY SHELTER ASSEMBLY

(71) Applicant: Timothy Henry Wood, Smyrna, GA (US)

(72) Inventor: Timothy Henry Wood, Smyrna, GA (US)

( * ) Notice: Subject to any disclaimer, the term of this patent is extended or adjusted under 35 U.S.C. 154(b) by 42 days.

(21) Appl. No.: 17/646,075

(22) Filed: Dec. 27, 2021

(65) Prior Publication Data

US 2022/0205272 A1 Jun. 30, 2022

Related U.S. Application Data

(60) Provisional application No. 63/199,431, filed on Dec. 28, 2020.

(51) Int. Cl.

| | |
|---|---|
| ***E04H 15/26*** | (2006.01) |
| ***E04H 15/44*** | (2006.01) |
| ***E04H 15/54*** | (2006.01) |
| ***E04H 15/64*** | (2006.01) |

(52) U.S. Cl.

CPC ..... *E04H 15/26* (2013.01); *E04H 15/44* (2013.01); *E04H 15/54* (2013.01); *E04H 15/64* (2013.01)

(58) Field of Classification Search

CPC ..... E04H 15/26; E04H 15/64; E04H 15/44

See application file for complete search history.

(56) References Cited

U.S. PATENT DOCUMENTS

| | | | | | |
|---|---|---|---|---|---|
| 2,679,255 | A | | 5/1954 | Stafford | |
| 3,162,920 | A | * | 12/1964 | Durham | A01F 25/13 24/265 R |
| 3,225,408 | A | * | 12/1965 | Durham | E04H 15/64 428/40.1 |
| 3,503,101 | A | * | 3/1970 | Arpad | E04H 15/64 24/443 |
| 3,896,830 | A | * | 7/1975 | Sharick | E04H 15/16 52/63 |
| 4,719,934 | A | | 1/1988 | Mydans | |
| 4,942,895 | A | * | 7/1990 | Lynch | E04H 15/26 135/114 |
| 5,234,011 | A | * | 8/1993 | Lynch | E04H 15/58 135/114 |
| 5,918,614 | A | * | 7/1999 | Lynch | E04H 15/54 135/114 |
| 7,134,443 | B1 | | 11/2006 | Shires | |
| 7,146,996 | B1 | | 12/2006 | Shires | |
| 7,189,024 | B2 | * | 3/2007 | Cameron | E04H 15/64 24/105 |

(Continued)

*Primary Examiner* — Noah Chandler Hawk

(74) *Attorney, Agent, or Firm* — Dunlap Bennett & Ludwig, PLLC

(57) ABSTRACT

A portable canopy shelter assembly is provided. The portable canopy shelter assembly includes a canopy that is dimensioned and adapted to engage a center pole and a plurality of outer poles. Adjustable tension members are provided for structural support through engaging the outer poles and peripheral edges of the canopy in an open condition. Attachment points connect the peripheral edges and the outer poles through a sandwiched pin configuration. The poles are collapsible, and so the canopy can be folded and rolled up in a storage condition enveloping the poles and the adjustable tension members into a kit dimensioned and adapted to fit in a backpack.

6 Claims, 7 Drawing Sheets

(56) References Cited

U.S. PATENT DOCUMENTS

| | | | | |
|---|---|---|---|---|
| 7,353,833 | B1 * | 4/2008 | Palmer | E04H 15/62 135/120.4 |
| 7,841,356 | B2 | 11/2010 | Shires | |
| 8,491,027 | B2 * | 7/2013 | Izzo | A45F 5/10 294/158 |
| 8,555,910 | B2 | 10/2013 | Webster et al. | |
| 8,684,020 | B1 | 4/2014 | Shires | |
| 9,410,343 | B2 | 8/2016 | Hotes | |
| 9,714,523 | B2 * | 7/2017 | Lilly, II | E04H 15/18 |
| 9,896,862 | B1 | 2/2018 | Cox | |
| 9,903,135 | B1 | 2/2018 | Todorov | |
| 10,364,588 | B2 | 7/2019 | Krenzel | |
| 10,837,195 | B2 | 11/2020 | Wiseman | |
| 2008/0302403 | A1 | 12/2008 | Stewart | |
| 2011/0030750 | A1 | 2/2011 | Lin et al. | |
| 2015/0330098 | A1 | 11/2015 | Schofield | |
| 2016/0290002 | A1 | 10/2016 | Michaelis et al. | |

* cited by examiner

PORTABLE CANOPY SHELTER ASSEMBLY

CROSS-REFERENCE TO RELATED APPLICATION

This application claims the benefit of priority of U.S. provisional application No. 63/199,431, filed 28 Dec. 2020, the contents of which are herein incorporated by reference.

BACKGROUND OF THE INVENTION

The present invention relates to outdoor equipment and, more particularly, a portable canopy shelter assembly movable between a storage condition and an open condition providing a spacious lightweight canopy shelter for backpacking and tailgating.

Current camping style canopy shelters are not large enough for larger group gatherings and rely on trees and other outdoor features to properly remain standing. For instance, traditional canopy style shelters are typically a tarp with the ends tied to trees or whatever is available. However, it is almost an axiom in outdoor activities that the tree is never in the right place, the rope isn't quite long enough to reach what one is trying to tie down, and/or the tarp is never quite big enough to provide shelter for larger gatherings. In short, something is always not quite right with these makeshift solutions.

Furthermore, camping shelters that may be adequate in car camping and tailgating are too heavy and bulky to carry long distances on foot, typically because of the weight of the canopy material and poles and rigging needed to provide adequate structural support to canopy material that is large enough to provide shade for large gatherings. As a result, when backpackers are huffing equipment long distances, they will opt not to pack a canopy, even though a canopy shelter would otherwise provide a comfortable common area for large groups to gather under.

As can be seen, there is a need for a portable canopy shelter assembly movable between a storage condition and an open condition providing a spacious lightweight canopy shelter, wherein the storage condition is amendable to being toted long distances on one's person.

The portable canopy shelter assembly of the present invention may include a canopy that is dimensioned and adapted to engage a center pole and a plurality of outer poles. Adjustable tension members are provided to provide structural support through engaging the outer poles and peripheral edges of the canopy in an open condition. Attachment points connect the adjustable tension members to the peripheral edges by way of a sandwiched pin configuration.

In the sandwiched pin configuration, the attachment points provide a sleeve for receiving a distal end of the outer pole. The sleeve terminates in a pin that is received through a canopy hole just inward of said peripheral edges. The pin is then also received through a fastener hole of an opposable fastener that sandwiches both sides of the peripheral edge and the pin received therethrough.

The poles are collapsible, and so the canopy can be folded and rolled up in a storage condition enveloping the poles and the adjustable tension members into a kit dimensioned and adapted to fit a backpack.

In certain embodiments, the portable canopy shelter assembly of the present invention may include a hexagonal canopy consisting of six triangular canopy panels, wherein each canopy panel consists of three subpanels, wherein the three quadrilateral subpanels consist of two trapezium subpanels and a kite subpanel.

The canopy assembly erected in the open condition provides a spacious covered area for large gatherings to move around in, rain or shine. In the open condition, the present invention does not require any trees or other outdoor features for the shelter to work properly. The canopy shelter embodied by the present invention can be set up in an open field and is larger than a tailgate tent when erected. The canopy shelter assembly can be compacted and stored in a backpack and carried long distances on foot in the storage condition.

SUMMARY OF THE INVENTION

In one aspect of the present invention, a portable canopy shelter assembly, the assembly includes the following: a canopy; a telescoping central pole connectable to a central connection of the canopy; a plurality of collapsible outer poles connectable to a plurality of attachment points along a periphery of the canopy by way of a sandwiched pin configuration having a mitten connector; and a plurality of adjustable tension members, each adjustable tension member removably attachable to the mitten connector.

In another aspect of the present invention, the portable canopy shelter assembly further includes the following: a tension member connected along the periphery of the canopy at a midpoint between two adjacent attachment points of the plurality of attachment points, wherein the canopy is a hexagonal canopy, and wherein each of the plurality of attachment points are disposed adjacent the six vertices of the hexagonal canopy, wherein the hexagonal canopy comprises six triangular canopy panels, wherein each canopy panel comprises three quadrilateral subpanels, and wherein the three quadrilateral subpanels comprise two trapezium subpanels and a kite subpanel, wherein, for each triangular canopy panel, the two trapezium subpanels interface at a radial line intersecting the midpoint, and wherein, for each triangular canopy panel, a vertex of the kite subpanel is on the radial line.

In yet another aspect of the present invention, the portable canopy shelter assembly further includes wherein the mitten connector includes a sleeve portion terminating in a sleeve pin and an opposable flap, and wherein each attachment point has peripheral hole through which the pin is received and sandwiched by the opposable flap in the sandwiched pin configuration, wherein the mitten connector includes a sleeve portion terminating in a sleeve pin and an opposable flap, and wherein each attachment point has a peripheral hole through which the pin is received and sandwiched by the opposable flap in the sandwiched pin configuration, wherein each peripheral hole is circumscribed on both sides of the canopy by two first portions, respectively, wherein the opposable flap has opposable second portions, wherein the first and second portions are hook and loop fastener portions, and wherein the opposable flap has a flap pin hole in a middle area between the opposable second portions, and wherein the pin is in the middle area.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable canopy shelter assembly movable between a storage condition and an open condition providing a spacious lightweight canopy shelter for backpack camping and tailgating. The portable canopy shelter assembly includes a canopy that is dimensioned and adapted to engage a center pole and a plurality of outer poles. Adjustable tension members are provided for structural support through engaging the outer poles and peripheral edges of the canopy in an open condition. Attachment points connect the peripheral edges and the outer poles through a sandwiched pin configuration. The poles are collapsible, and so the canopy can be folded and rolled up in a storage condition enveloping the poles and the adjustable tension members into a kit dimensioned and adapted to fit in a backpack.

Figure 1:
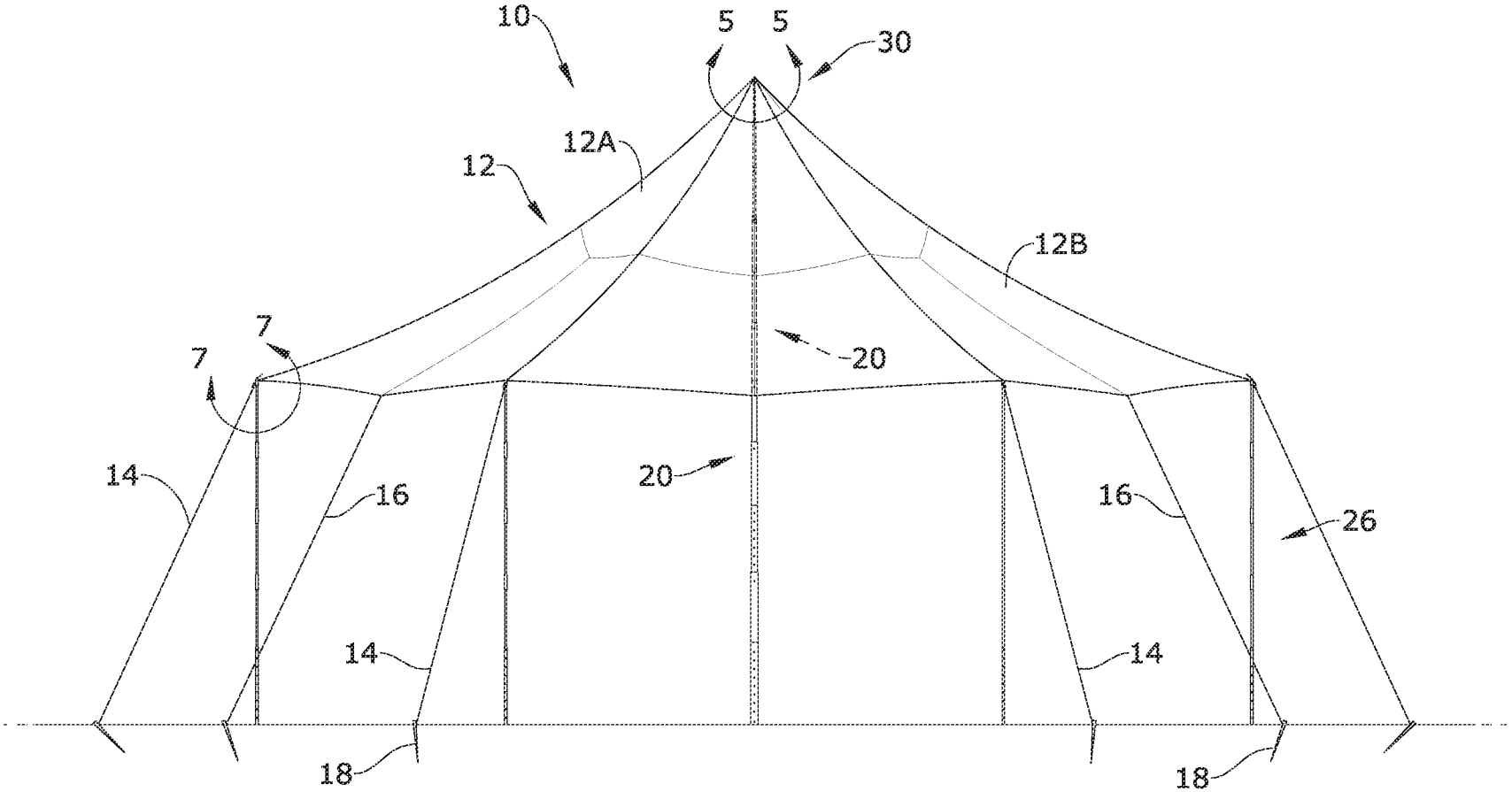
FIG. 1 is a front elevation view of an exemplary embodiment of a lightweight canopy shelter of the present invention.
Figure 2:
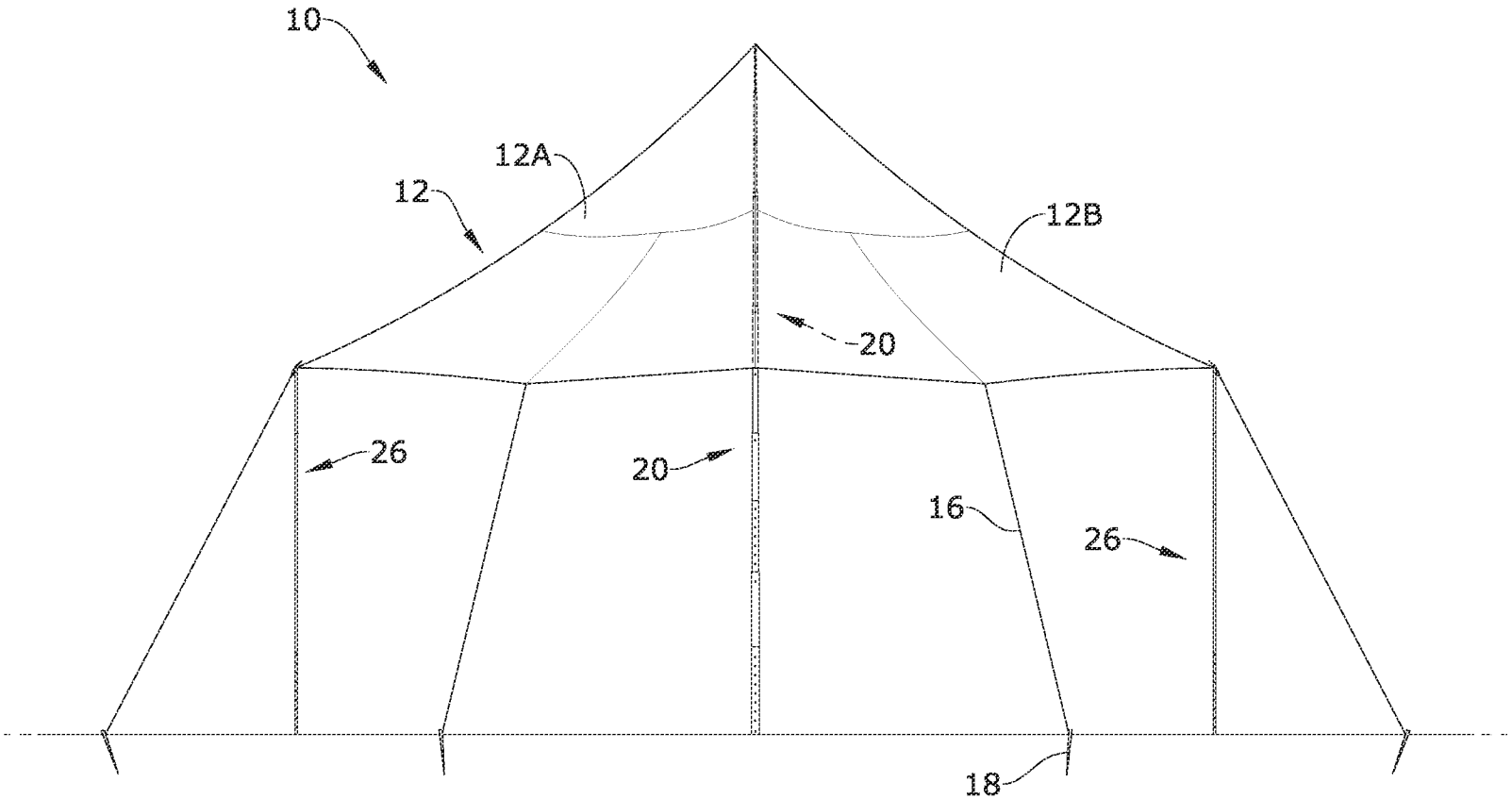
FIG. 2 is a side elevation view of an exemplary embodiment of the lightweight canopy shelter of the present invention.

Referring now to FIGS. 1 and 2, the present invention may include a portable canopy shelter assembly 10. The portable canopy shelter assembly 10 may include a canopy 12, a collapsible center pole 20, and plurality of collapsible outer poles 26, as well as a plurality of adjustable tension members 16 and 14 for tensive engagement of the peripheral attachment points 40 of the canopy 12 and the outer poles 26, respectively.

Figure 3:
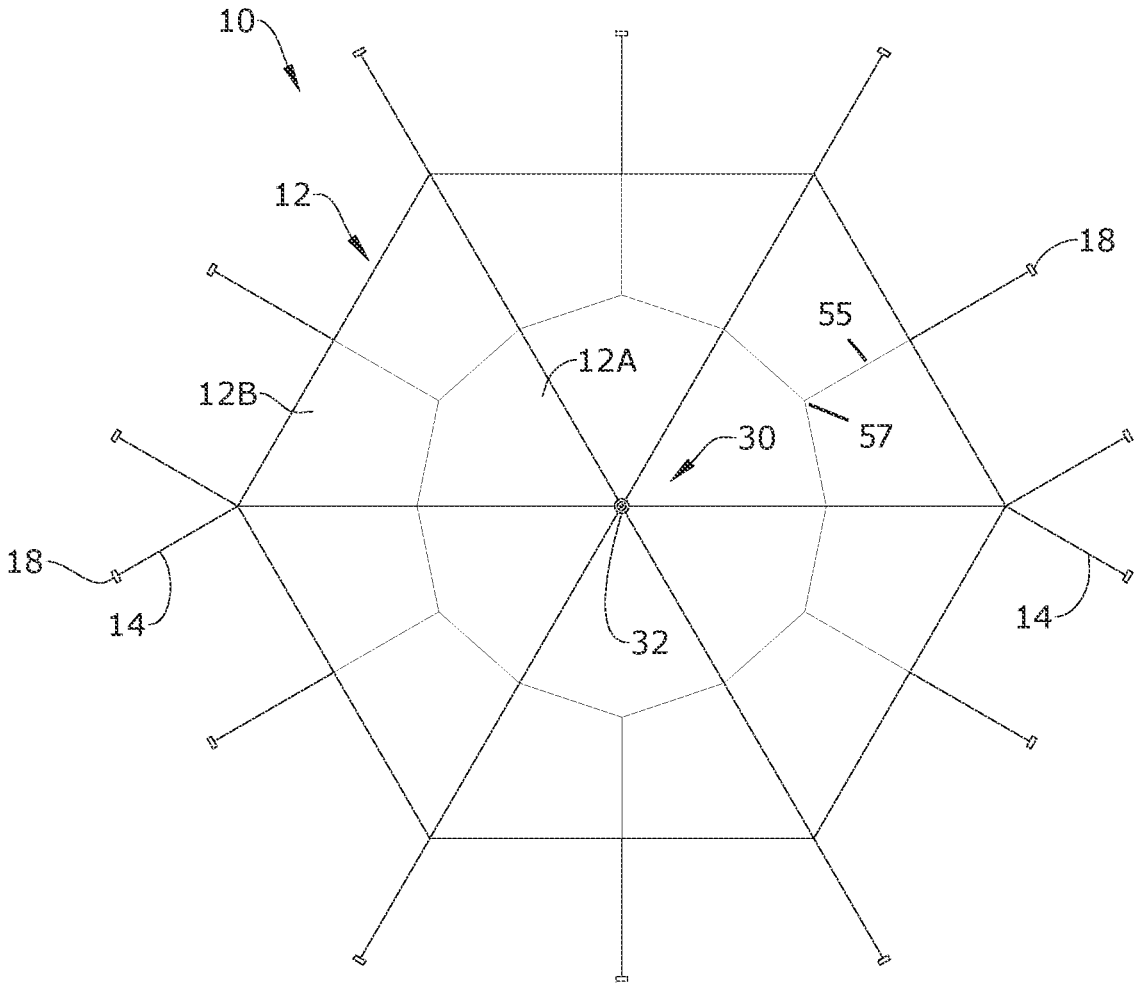
FIG. 3 is a top plan view of an exemplary embodiment of the present invention.
Figure 4:
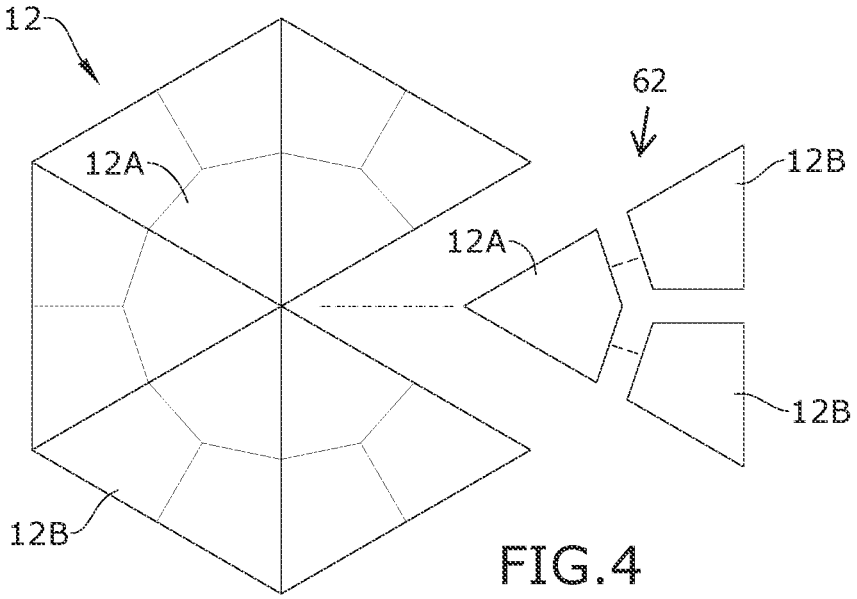
FIG. 4 is a top plan view of an exemplary embodiment of the present invention, wherein a representative canopy panel is shown exploded into its constituent subpanels.

Referring the FIGS. 3 and 4, the waterproof canopy 12 may be a hexagonal shape comprised of six triangular canopy panels 62 wherein each canopy panel 62 comprises of three quadrilateral subpanels 12A and 12B, wherein the three quadrilateral subpanels comprise a kite subpanel 12A and two trapezium subpanels 12B.

Figure 5:
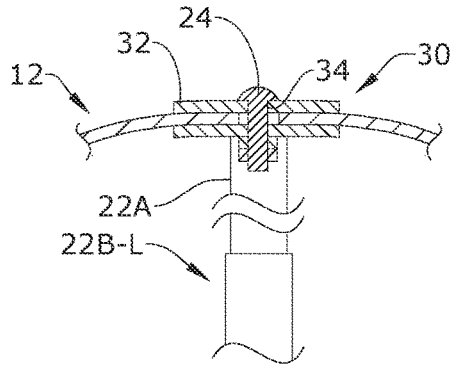
FIG. 5 is a detailed cross-sectional view of an exemplary embodiment of a center connection of the present invention, indicated by line 5-5 of FIG. 1.

Referring to FIGS. 4 and 5, the collapsible center pole 20 attaches to the canopy 12 at its center or centroid by way of a central connection 30. The central connection 30 may include a central hole 34, and a center cap 32 that sandwiches both the upper and lower sides of a portion of the canopy 12 that circumscribes the central hole 34 so that a fastener 24 (including but not limited to a pin) may slide through an upper side of the central hole 34, through the lower side of the central hole, and into a distal segment 22A of the collapsible center pole 20.

Referring to FIGS. 8 through 11, the collapsible center pole 20 includes a plurality of telescoping segments 22A through 22L for an eleven-segment collapsible center pole 20 shown in the Figures. It should be understood that the collapsible center pole 20 may include more or less than eleven telescoping segments 22A-22L. Each telescoping segment may have one or more snap button adjustment holes 25 for selectively locking adjacent telescoping segments relative to each other by way of engaging a spring-biased snap button 23 of the adjacent telescoping segment through one of the snap button adjustment holes 25. The telescoping segments 22A-22L are tubular so that the spring-biased snap button 23 are disposed in the lumen; likewise, an adjacent (more-distal and smaller) segment can nest in the adjacent telescoping segment. A pole cap 21 may cap a proximal end of the center pole 20, wherein during use the pole cap 21 engages a supporting surface, such as the ground.

Figure 12:
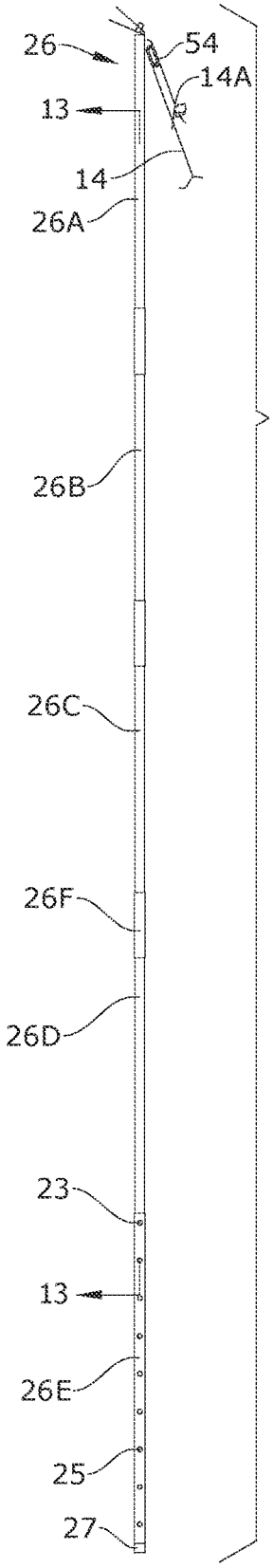
FIG. 12 is a front elevation view of an exemplary embodiment of a collapsible outer pole of the present invention.
Figure 13:
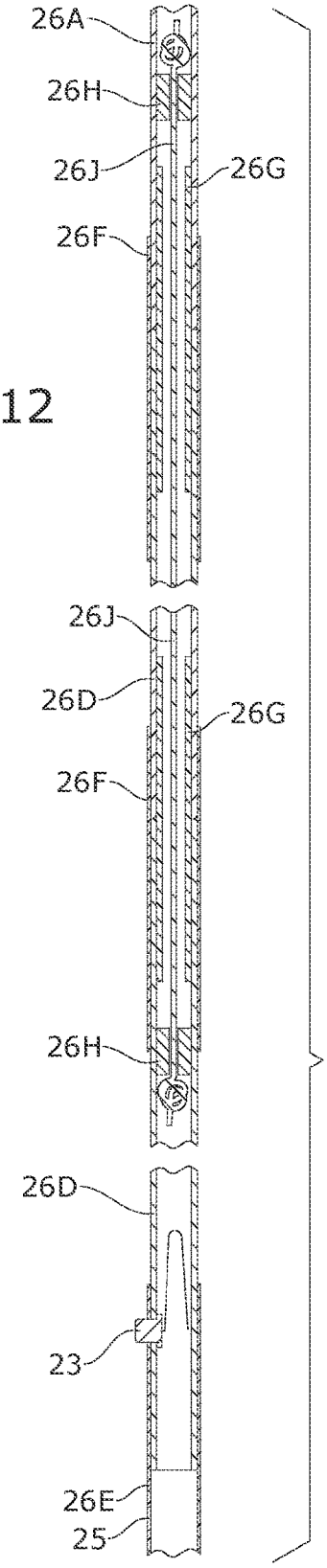
FIG. 13 is an enlargement of the section view taken along line 13-13 of FIG. 12 of the collapsible outer pole.
Figure 14:
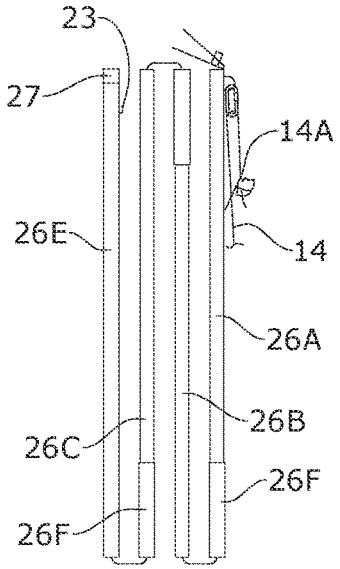
FIG. 14 is a front elevation view of an exemplary embodiment of the outer pole of the present invention in a collapsed position.
Figure 15:
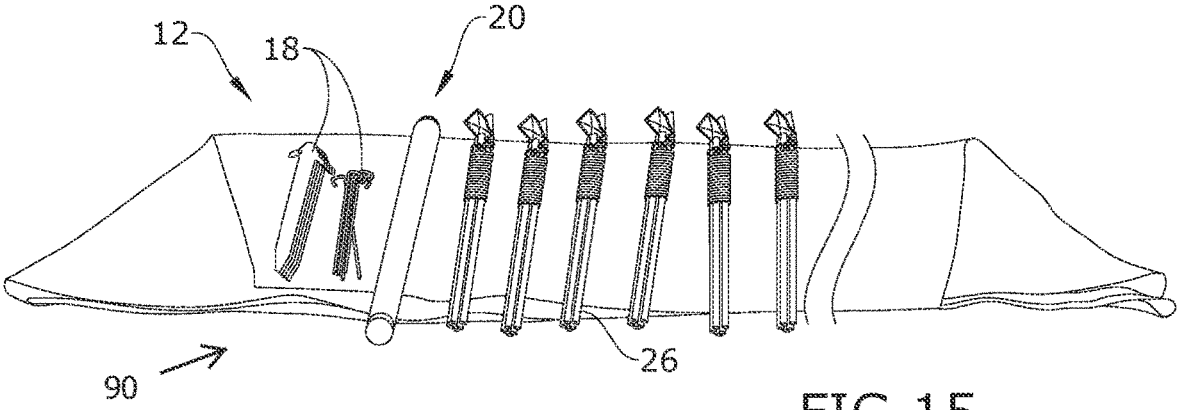
FIG. 15 is a perspective view of an exemplary embodiment of a kit of the present invention.
Figure 16:
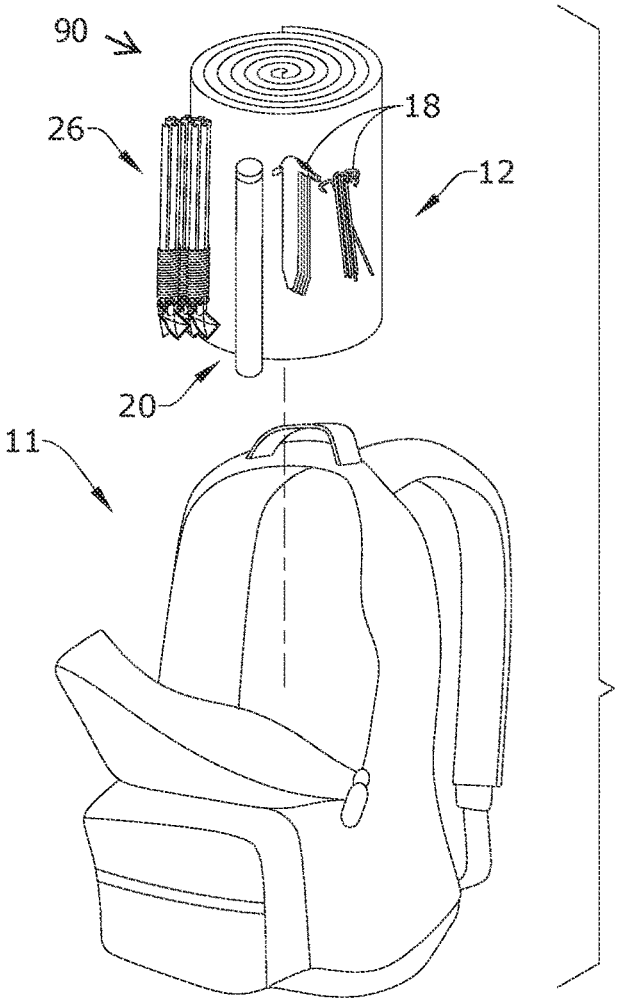
FIG. 16 is an exploded perspective view of an exemplary embodiment of the kit of the present invention and a backpack.

Referring to FIGS. 12 through 14, the collapsible outer poles 26 each may include a plurality of shock cord segments 26A through 26E. It should be understood that the collapsible outer poles 26 may include more or less than five shock cord segments 26A-26E. Each shock cord segment may be tubular with an outer coupling sleeve 26F, an inner coupling sleeve 26G, a shock cord guide 26H disposed in the lumen so that the shock cord 26J extends through all the shock cord segments 26A-26E in such a way that each shock cord segment 26A-26E can be physically disconnected from its adjacent shock cord segment(s) while the shock cord 26J still interconnects all of the shock cord segments 26A-26E. Thereby, each shock cord segment can be aligned in a parallel orientation bunched up relative to the other shock cord segments, as illustrated in FIG. 14. A pole cap 27 may cap a proximal end of the outer pole 26, wherein during use the pole cap 27 engages a supporting surface, such as the ground.

Figure 6:
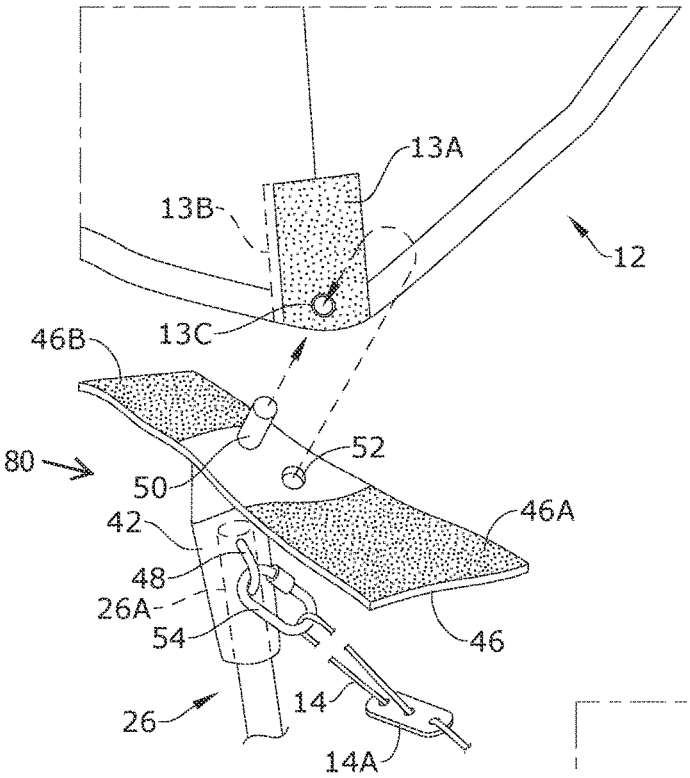
FIG. 6 is an exploded detailed perspective view of an exemplary embodiment of an attachment point of the present invention, shown in a disengaged condition with an adjustable tension member broken away for clarity.
Figure 7:
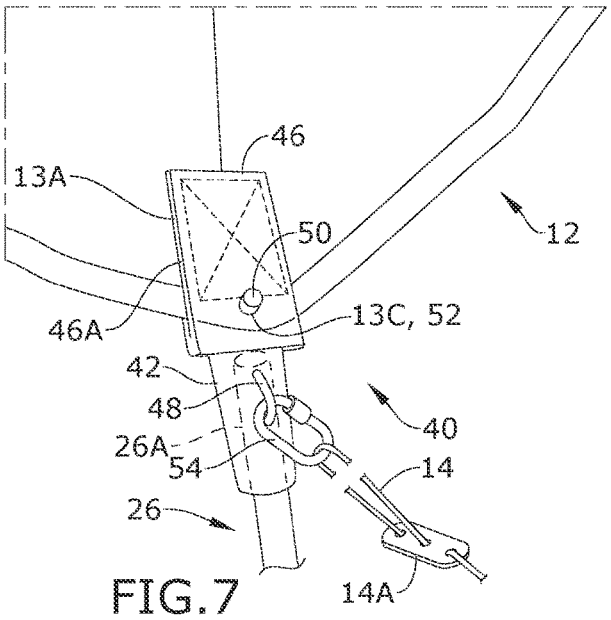
FIG. 7 is a detailed perspective view of an exemplary embodiment of an attachment point of the present invention, shown in an engaged condition with the adjustable tension member broken away for clarity.
Figure 8:
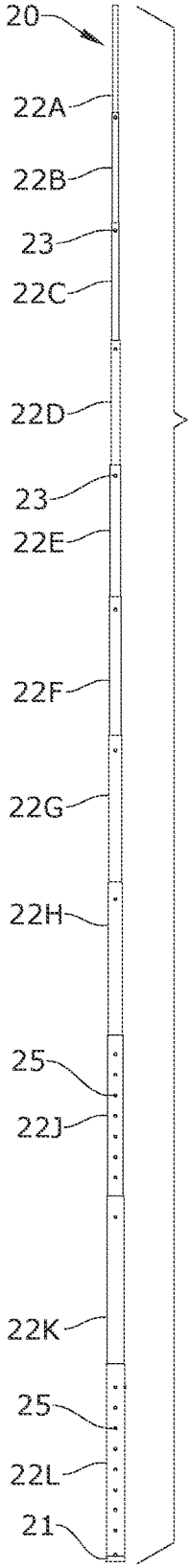
FIG. 8 is a front elevation view of an exemplary embodiment of a telescoping center pole of the present invention.
Figure 9:
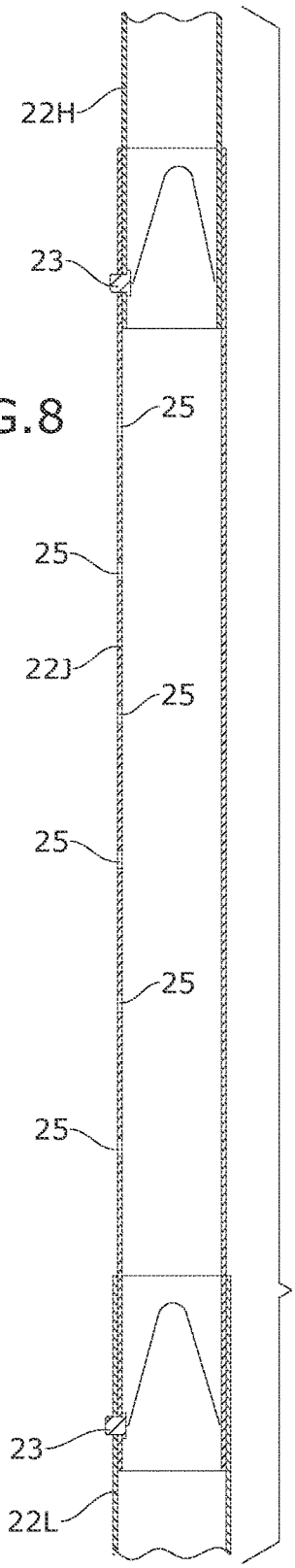
FIG. 9 is a detailed section view of an exemplary embodiment of a telescopic segment of the telescoping center pole of FIG. 8.
Figure 10:
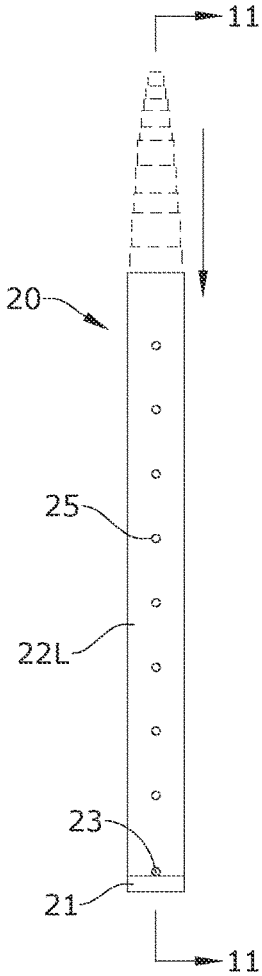
FIG. 10 is a front elevation view of an exemplary embodiment of the telescoping center pole in a collapsed position.
Figure 11:
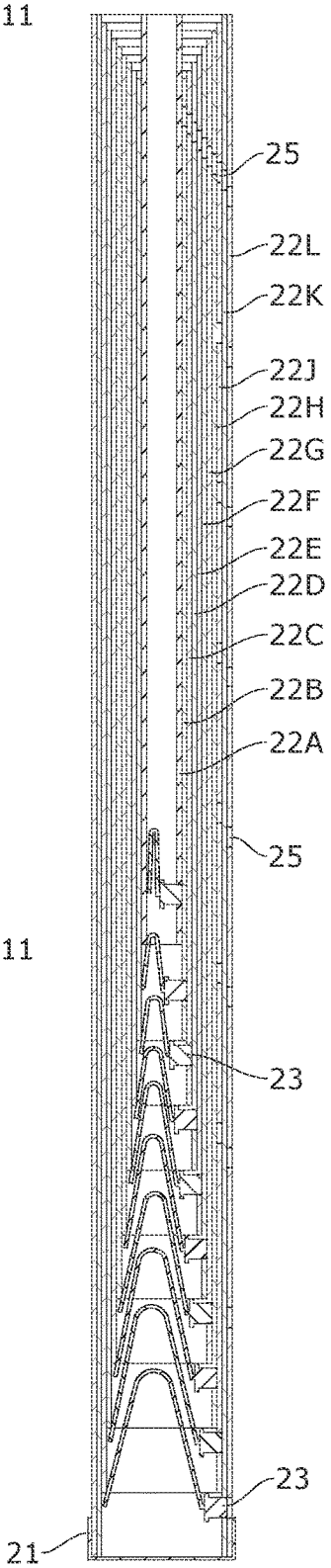
FIG. 11 is a section view of the collapsed center pole, taken along line 11-11 of FIG. 10.

Referring to FIGS. 6 and 7, a distal segment 26A of each outer pole 26 interconnects with an attachment point 40. The attachment point 40 may define a sandwiched pin configuration. The sandwiched pin configuration may embody (i) a peripheral hole 13C just inward of a periphery of the canopy 12 and (ii) a mitten connector 80 operatively associated with the distal segment 26A. The peripheral pin hole 13C may be surrounded by first portions 13A and 13B of hook and loop fastener portions of both sides of the canopy 12. The mitten connector 80 provides a sleeve portion 42 for slidably receiving the distal segment 26A. The mitten connector 80 terminates with a pin 50 and an opposable flap 46. The opposable flap 46 provides opposable second portions 46A and 46B of hook and loop fastener portions on opposing ends of the flap 46. The opposable flap 46 also provides a flap pin hole 52 in a middle area between the opposable second portions 46A and 46B. The pin 50 may also be in the same middle area. The attachment point 40 is movable between a disengaged condition (FIG. 6) and an engaged condition (FIG. 7), whereby the pin 50 is received through both the peripheral pin hole and the flap pin hole 52 with the opposable second portions 46A and 46B engaging the first portions 13A and 13B on both sides of the canopy 12, sandwiching the received pin 50 therebetween. The sleeve portion 42 may provide a loop 48 for removably engaging a shackle connector 54. The term mitten connector is understood to be defined by the above disclosure and related figures.

An adjustable tension member 14 may engage the shackle connector 54. Each adjustable tension member 14 may have an adjustor 14A slidably connected thereto for selectively adjusting the length of the adjustable tension member 14, and thus the tensile force it translates to the shackle connector 54, and thus the attachment point 40 by extension. In certain embodiments, each attachment point 40 may include two adjustable tension members 14 disposed to extend away from each other and the attachment point 40, as illustrated in FIG. 3.

A canopy tension member 16 may engage peripheral portions of the canopy 12 not also engaged by an outer pole 26. In certain embodiments, the canopy tension member 16 engages at the intersection/seam 55 of the above-mentioned two trapezium subpanels 12A and 12B, as illustrated in FIG. 3. The tensile force transmits through the seam 55 to the vertex 57 of the kite subpanel 12A, thereby efficiently (non-eccentrically) loading the kite subpanel 12A relative to the central connection 30. The tension members 14 and 16 may be guy lines. The opposite ends of the tension members 14 and 16 may be anchored to the supporting surface by way of stakes 18.

When all attachment points 40 are pulled tight with the tension members 14 the hexagonal canopy 12 structure pattern takes shape, whilst the center connection 30 of the canopy is held up by the center pole 20. Adjustments to the canopy tension members 16 can be made to the overall canopy shelter assembly 10 in the open condition.

The poles 20 and 26 are collapsible, and so the canopy 12 can be folded and rolled up in a storage condition enveloping the poles 20 and 26 and the adjustable tension members into a kit 90, dimensioned and adapted to fit in a backpack 11. The poles 20 and 26 may be made of carbon fiber or similarly lightweight, durable, bending-resistant material.

A method of using the present invention may include the following. The canopy shelter assembly 10 disclosed above may be provided. The canopy shelter 10 may be packed as a kit 90 in a backpack 11 and taken on a backpacking trip or other long distance hiking adventures. Once a user has reached their destination, it is time to set up the kit 90, wherein the user removes the kit 90 from the backpack 11 and unrolls the canopy 12. Then the user puts each of the plurality of collapsed outer poles 26 and the telescoping central pole 20 into the extended condition. Then the user may unfurl the canopy 12 and lay it out flat where they want to erect the canopy shelter assembly 10. Now the user may attach the outer poles 26 to the attachment points 40 by way of the sandwiched pin configuration FIG. 6 & FIG. 7. The tension members 14 and 16 may be connected to the outer poles 26 and canopy and staked to the ground. The tension members 14 and 16 may be pulled tight with the rope adjusters on each rope. In certain embodiments, the tension members 14 and 16 stay connected to the canopy and outer poles. Tension members 14 are wrapped around the collapsed-out poles when stored, tension members 16 stay connected to the canopy and are folded up with the canopy when stored.

This canopy shelter assembly 10/kit 90 can also be used for sporting events, disaster relief efforts, military exercises, wedding events, social events, entertainment purposes like connecting a screen fabric between two of the outer poles to project an image on it with a projector. The canopy shelter assembly 10 is a great opportunity for string lighting inside the canopy shelter. The string lighting would connect to the inside of the canopy and would be customized to have the battery source connect to the center pole 20. Side walls can also be an added option that could be sold separately if desired from the main canopy shelter product. A custom-made projector screen can also be sold separately from the main canopy shelter. A projector platform to hold a portable projector could be attached to the center telescoping rod and it would be possible to watch a TV program outdoors.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A portable canopy shelter assembly, the assembly comprising:

a canopy;

a telescoping central pole connectable to a central connection of the canopy;

a plurality of collapsible outer poles connectable to a plurality of attachment points along a periphery of the canopy by way of a sandwiched pin configuration having a mitten connector;

a plurality of adjustable tension members, each adjustable tension member removably attachable to the mitten connector; and a tension member connected along the periphery of the canopy at a midpoint between two adjacent attachment point of the plurality of attachment points, wherein the canopy is a hexagonal canopy, and wherein each of the plurality of attachment points are disposed adjacent the six vertices of the hexagonal canopy, wherein the hexagonal canopy comprises six triangular canopy panels, wherein each canopy panel comprises three quadrilateral subpanels, and wherein the three quadrilateral subpanels comprise two trapezium subpanels and a kite subpanel.

2. The assembly of claim 1, wherein, for each triangular canopy panel, the two trapezium subpanels interface at a radial line intersecting the midpoint.

3. The assembly of claim 2, wherein, for each triangular canopy panel, a vertex of the kite subpanel is on the radial line.

4. The assembly of claim 1, wherein the mitten connector includes a sleeve portion terminating in a sleeve pin and an opposable flap, and wherein each attachment point has a peripheral hole through which the pin is received and sandwiched by the opposable flap in the sandwiched pin configuration.

5. The assembly of claim 4, wherein each peripheral hole is circumscribed on both sides of the canopy by two first portions, respectively, wherein the opposable flap has opposable second portions, wherein the first and second portions are hook and loop fastener portions.

6. The assembly of claim 5, wherein the opposable flap has a flap pin hole in a middle area between the opposable second portions, and wherein the pin is in the middle area.

* * * * *